US006681542B2

(12) United States Patent
Pribyl

(10) Patent No.: US 6,681,542 B2
(45) Date of Patent: Jan. 27, 2004

(54) STAIR BLOCK FOR USE IN LANDSCAPING AND METHOD FOR USE THEREOF

(75) Inventor: Gary F. Pribyl, Cedar Rapids, IA (US)

(73) Assignee: King's Material, Inc., Cedar Rapids, IA (US)

( * ) Notice: Subject to any disclaimer, the term of this patent is extended or adjusted under 35 U.S.C. 154(b) by 0 days.

(21) Appl. No.: 10/045,856

(22) Filed: Nov. 7, 2001

(65) Prior Publication Data

US 2002/0066251 A1 Jun. 6, 2002

Related U.S. Application Data

(62) Division of application No. 09/440,405, filed on Nov. 15, 1999.

(51) Int. Cl.[7] ..... E04C 2/04; E04B 5/04; E04B 1/00; E04F 11/00

(52) U.S. Cl. ..... 52/606; 52/607; 52/189; 52/100

(58) Field of Search ..... 52/606, 607, 741.2, 52/189, 182, 98, 100

(56) References Cited

U.S. PATENT DOCUMENTS

| | | | | | |
|---|---|---|---|---|---|
| 1,831,858 | A | * | 11/1931 | Haggard | 52/606 |
| 2,172,051 | A | | 9/1939 | Robbins | |
| 3,222,830 | A | * | 12/1965 | Ivany | |
| 3,478,482 | A | * | 11/1969 | Weir | |
| 4,229,123 | A | * | 10/1980 | Heinzmann | |
| 4,335,549 | A | * | 6/1982 | Dean | |
| 4,527,373 | A | * | 7/1985 | Cruise | |
| 4,640,071 | A | * | 2/1987 | Haener | 52/286 |
| 4,887,403 | A | * | 12/1989 | Bonner | |
| 4,964,761 | A | * | 10/1990 | Rossi | |
| 5,062,610 | A | | 11/1991 | Woolford et al. | |
| 5,339,578 | A | * | 8/1994 | Smerchanski | |
| 5,379,565 | A | * | 1/1995 | Vienne | 52/606 |
| 5,409,325 | A | | 4/1995 | Wu | |
| 5,479,746 | A | | 1/1996 | Mannonen | |
| 5,589,124 | A | | 12/1996 | Woolford et al. | |
| 5,620,283 | A | | 4/1997 | Walter | |
| D384,168 | S | | 9/1997 | Stevenson | |
| 5,678,958 | A | | 10/1997 | Rossi | |
| 5,827,015 | A | | 10/1998 | Wooldford et al. | |
| 6,082,057 | A | * | 7/2000 | Sievert | |
| 6,082,067 | A | * | 7/2000 | Bott | |
| 6,082,933 | A | * | 7/2000 | Maguire | |
| 6,189,282 | B1 | * | 2/2001 | VanderWerf | |

FOREIGN PATENT DOCUMENTS

| | | | |
|---|---|---|---|
| CA | 454771 | * | 6/1942 |
| CH | 273890 | * | 12/1945 |
| IT | 409614 | * | 7/1943 |

OTHER PUBLICATIONS

Borgert Products, Inc. advertising entitled "Steps Made Easy! With Stair Stackers" Borgert Products, Inc., P.O. Box 39, St. Joseph, Minnesota 56374.

Decor Innovative Concrete Systems—"Step Stacker" brochure. Decor 682 Arvin Avenue, Stony Creek, Ontario, Canada L8E5R4.

* cited by examiner

*Primary Examiner*—Carl D. Friedman
*Assistant Examiner*—Kevin McDermott
(74) *Attorney, Agent, or Firm*—Allan L. Harms

(57) ABSTRACT

A block for an outdoor staircase stair includes an open four-sided block having a web interconnecting opposing sides and transversing the cavity within the block. The web includes vertical voids which extend from the top of the web into the body of the web. Two of the voids are located at the lateral ends of the web. The top parts of the web between the voids are broken out after the block is placed over the ground surface. Each block may be placed such that its front wall rests on the rear wall of the course of blocks below it. The blocks are filled with granular material to within about the thickness of a paving block or brick. Paving blocks are arranged on the granular material within the block such that the tops of the paving blocks are flush with the top of the block. Methods for building a staircase from the blocks and for molding the blocks are also described.

20 Claims, 5 Drawing Sheets

STAIR BLOCK FOR USE IN LANDSCAPING AND METHOD FOR USE THEREOF

CROSS-REFERENCE TO RELATED APPLICATIONS

This application is a division of co-pending application Ser. No. 09/440,405 which was filed Nov. 15, 1999.

BACKGROUND OF THE INVENTION

The present invention relates to stairway components used in landscaping. Current methods of creating stairs in outdoor settings include the use of landscape timbers, casting of concrete forms in place, or precasting concrete, or by the use of bricks, paving blocks or concrete slabs arranged to serve as stair components. Each of these methods is very labor intensive and is susceptible to large variations in result. One effort to provide prefabricated concrete stair components is disclosed in U.S. Pat. No. 5,479,746. The devices of this patent include an assortment of components which are stacked to create various stairway or platform arrangements. An open-centered elongate block used to receive individual rectangular blocks is offered for sale under the name STAIR STACKER™ by Borgert Products, Inc. and STEP STACKER by Decor Innovative Concrete Systems. This product does not provide any stabilization of the sides of the open block and features a flat face which does not blend with surrounding components of a block retaining wall. Due to the open structure of this prior art stair block, dimensions may vary caused by the lack of predictable spacing between the longer walls during curing of the concrete within the block forms.

SUMMARY OF THE INVENTION

A stair component block constructed of zero slump concrete is formed with a hollow center section surrounded by orthogonal upright walls. Two opposing walls are interconnected with a narrow vertical web which is provided with two or three vertical slots extending from its top edge toward generally the center of the web. Additional vertical slots are formed in the web at the intersections of the web and the opposing walls interconnected by the web. Each of these slots extends from the top edge of the web part way to the bottom of the web. The web is so slotted such that the top part of the web may be easily removed by striking the sides of the top of the web after the block has been placed. The broken pieces of the web can be left within the central opening of the block during installation. The block is then partly filled with compacted granular material with a covering layer of sand up to a level below the block's top edges equal to the thickness of paving blocks or bricks to be placed atop the sand layer. Paving blocks or paving bricks may then be placed within the block above the sand in varying arrangements according to the installer's choice of design. The paving blocks are set such that the tops thereof are generally flush with the tops of the outer walls of the stair block.

The outside vertical corners of the blocks are beveled and the outside faces of the vertical walls are formed with vertical grooves formed therein spaced such that seams between adjoining blocks will appear to be part of a continuous wall. The inner and outer comers of the tops of the upright walls are radiused to provide a rounded step surface for the stair user and to blend and match with the corners of the usual paving block to be installed within the opening of the block. The blocks may be formed of dyed concrete in any of many colors as desired.

It is an object of the invention to provide a stair component for landscaping applications which is factory produced at low cost and high efficiency.

It is a further object to provide an easily installed stairway block which can be used to retain paving blocks in its top section to provide a decorative staircase in landscaping applications.

It is a further object to provide a stairway block which is easily handled by the installer.

It is also an object of the invention to provide a stair block which is stabilized during installation with a transverse stabilizing web.

It is a further object to provide a stairway block which is aesthetically compatible with retaining walls made from blocks.

It is also an object of the invention to provide a stairway block which is easy to use and which may be successfully installed on a "do-it-yourself" basis.

It is also an object of the invention to provide a landscaping stair block with rounded upper corners.

It is further an object of the invention to produce a landscaping stair block which is versatile in arrangement while having an easily removable stabilizing web.

These and other objects of the invention will be understood from examination of the accompanying drawings and the detailed description which follows.

DESCRIPTION OF THE DRAWING FIGURES

DETAILED DESCRIPTION OF THE INVENTION

Figure 1:
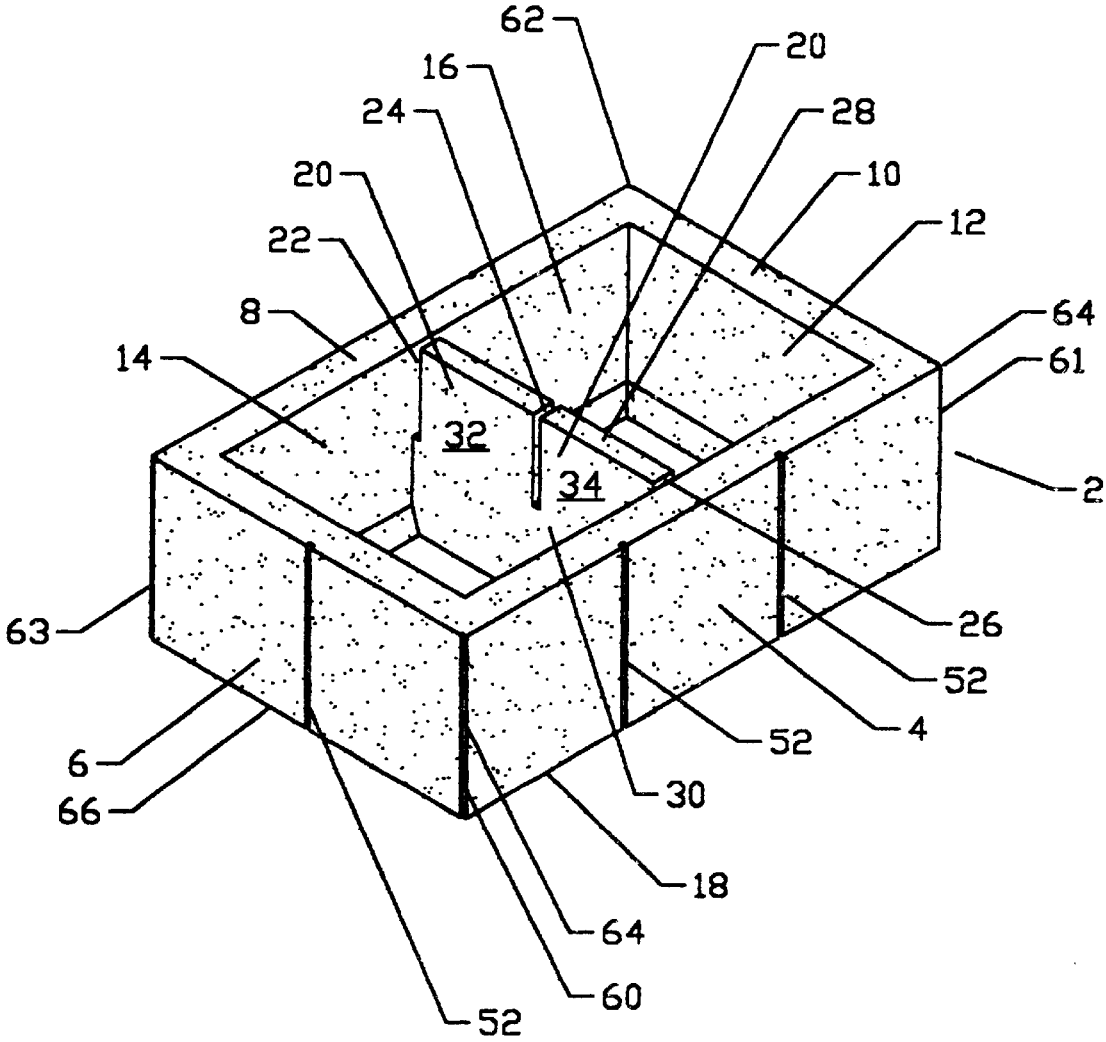
FIG. 1 is a front left perspective of the stair block according to the present invention.
Figure 2:
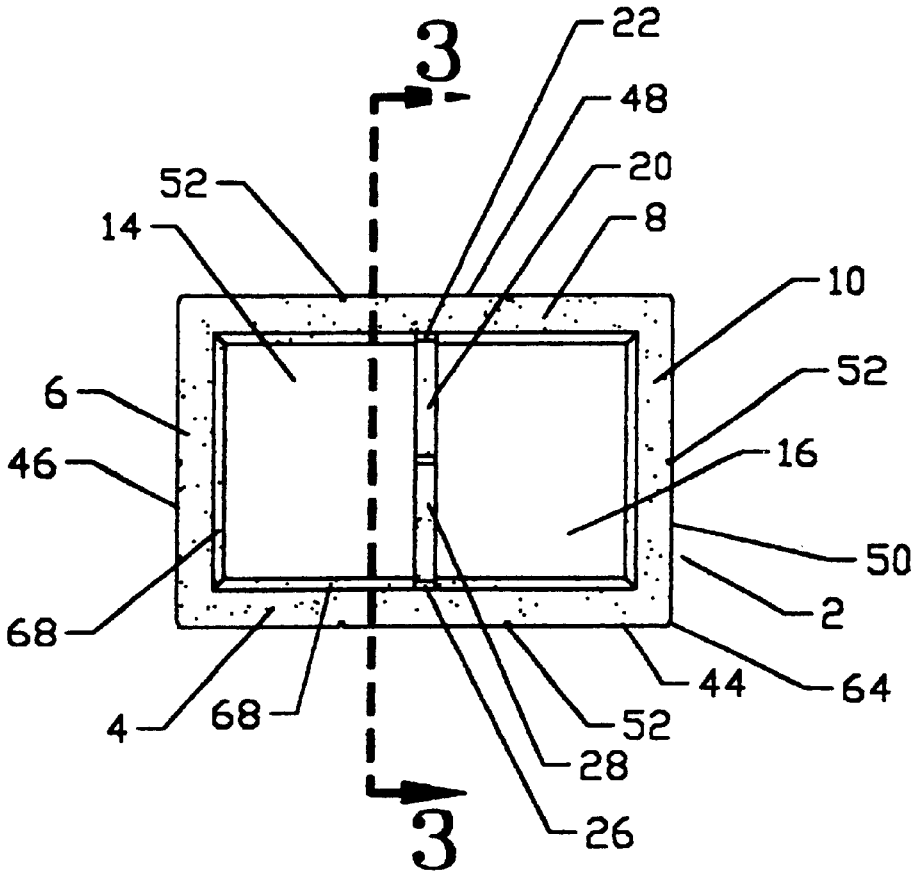
FIG. 2 is a top plan view of the stair block of FIG. 1.
Figure 3:
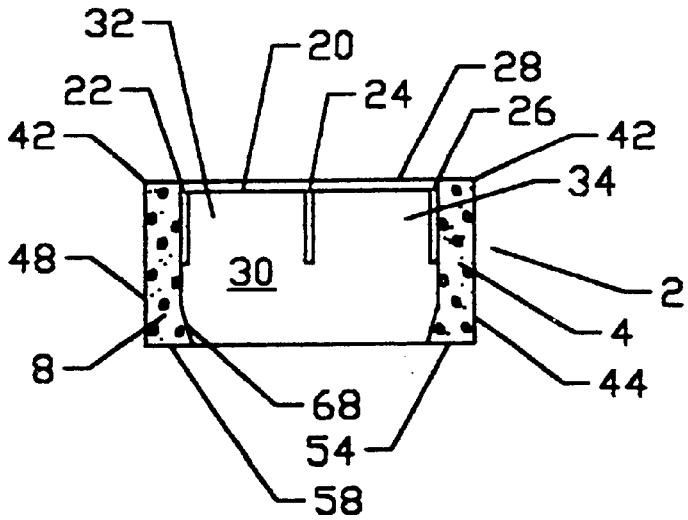
FIG. 3 is a cross section view taken along line 3—3 of FIG. 2.

FIGS. 1, 2, and 3 of the drawings illustrate the preferred embodiment of the invention composite concrete block 2. The block is preferably of rectangular shape having opposing end walls 6 and 10 joined to opposing sidewalls 4, 8, and an open top 12, with sidewalls 4 and 8 being longer than end walls 6 and 10. In the preferred embodiment, sidewalls 4 and 8 are approximately fifty percent longer than end walls 6 and 10. Centrally disposed within block 2 are cavities 14 and 16 which extend from top 12 to the bottom 18 of block 2. Separating cavities 14 and 16 is web 20 which interconnects opposing sidewalls 4 and 8 approximately midway along each. Web 20 is of a thickness substantially less than the thicknesses of front sidewall 4 and rear sidewall 8 and end walls 6 and 10 and is integrally formed with the sidewalls 4, 8 and end walls 6, 10. Web 20 is provided with a plurality of spaced apart generally vertical narrows 22, 24, 26 which extend from the top edge 28 of web 20 into the body 30 of web 20. Preferably void 22 is disposed in web 20 at the intersection of web 20 with sidewall 8 and void 26 is disposed at the intersection of web 20 with sidewall 4 while void 24 is disposed substantially equidistant from voids 22 and 26. Preferably web 20 is of the same height as sidewalls 4 and 8 and voids 22, 24, 26 may extend approximately halfway through the body 30 of web 20; however, voids 22, 24, 26 must extend into web 20 at least the height of a paving block, tat is approximately 2⅝ inches to 3 inches and preferably 3½ inches. When block 2 is set on a generally level granular base, a user may remove the top segments 32 and 34 of web 20 and may discard the broken pieces thereof into cavities 14 and 16 or otherwise dispose of them. The user then may fill cavities 14 and 16 wit granular material in suitable rises to a level below the top 12 of block 2 which allows placement of plural paving blocks on the fill such that the tops of the paving blocks are flush with the top 12 of block 2. The smaller paving blocks may be installed in various patterns as desired by the user.

The exterior vertical surfaces 44 and 48 of sidewalls 4, 8 respectively are provided with narrow vertical indentations or V-shaped grooves 52, preferably visually dividing the outer surfaces 44 and 48 into thirds. The outer surfaces 46 and 50 of end walls 6 and 10 respectively are each similarly provided with at least one vertical indentation or v-shaped groove 52 which is generally equidistant from the ends of the end walls 6, 10 to visually divide end walls 6, 10 into halves. Each groove 52 is approximately one fourth inch on each side. Each vertical corner 60, 61, 62, 63 of block 2 is provided with a small bevel 64 along its length. The grooves 52 blend visually with the seams created by bevels 64 on horizontally adjacent blocks 2.

Referring to FIG. 3, it can be seen that the upper outside corners 42 of sidewalls 4 and 8 are rounded along a radius suitable for a stair, approximately a one half inch radius. It should also be understood that the lower ends 54, 58 of sidewalls 4 and 8 are enlarged slightly and gradually at ramp regions 68 to strengthen the sidewalls 4 and 8 as well as to give a stronger base for resting the block 2 on a pallet during the forming process and to ease the stripping of the block 2 from its mold. Similarly the lower ends 66, 70 of end walls 6 and 10 are also graduated inwardly. The enlargements of lower ends of sidewalls 4, 8, and walls 6, 10 create ramp regions 68 adjoining the cavities 14, 16.

Preferably the length of end walls 6, 10 is nominally 15 ⅝ inches while the length of side walls 4, 8 is nominally 23 ⅞ inches. The height of each of end walls 6, 10 and sidewalls 4, 8 is nominally seven inches. Each wall 4, 6, 8, 10 may alternatively be six and three fourth inches high or eight inches high. The thickness of end walls 6, 19 and side walls 4, 8 is nominally one and three fourth inches and each is rounded on a one-half inch radius at its upper corners. Web 20 is nominally one and three sixteenth inches in thickness and extends between sidewalls 4, 8. Voids 22, 24, 26 are each nominally one-fourth inch wide and extend approximately three and one half inches into web 20.

Figure 4:
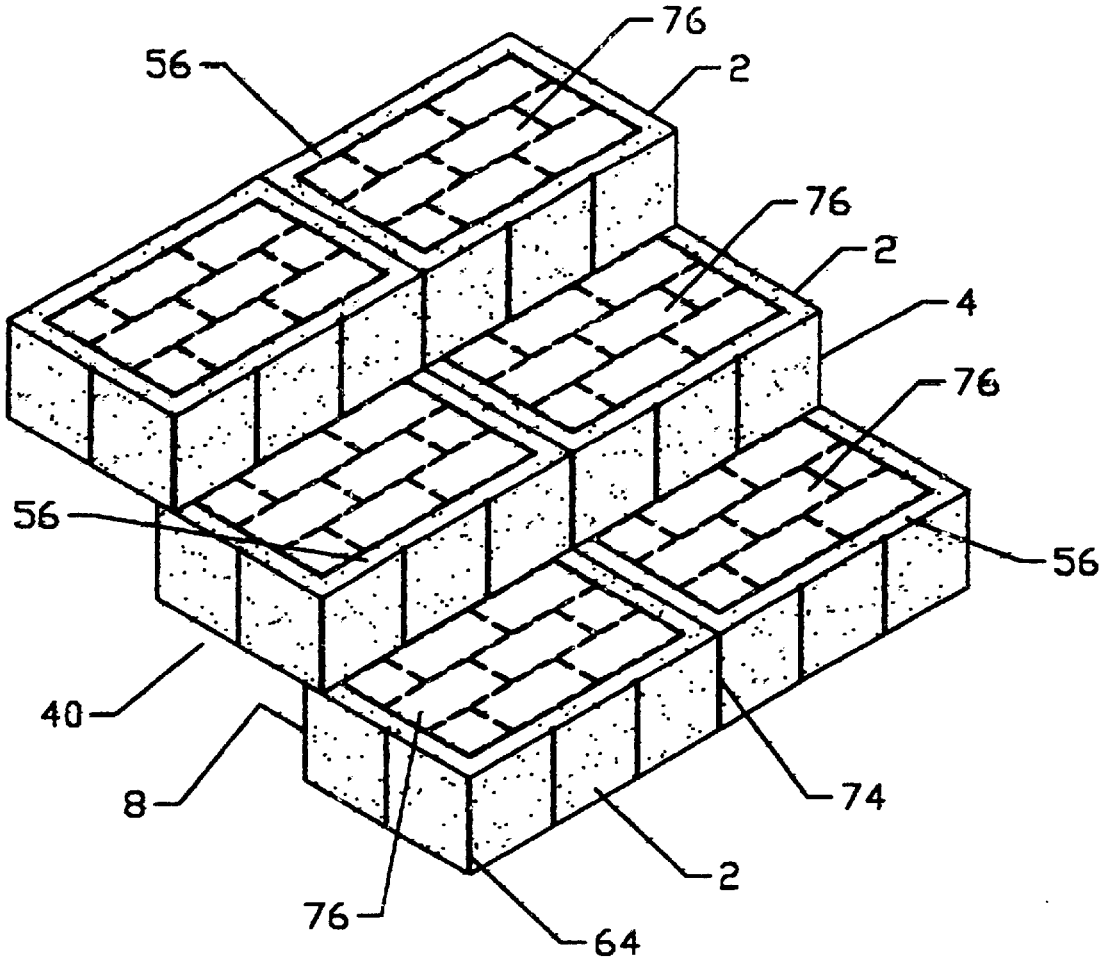
FIG. 4 is a perspective view of a stair constructed with the stair block of FIG. 1 with paving blocks installed therewithin shown by dashed lines.

FIG. 4 depicts a staircase 40 constructed from blocks 2 arranged such that each next higher course of blocks 2 rests with the front sidewalls 4 thereof on the rear sidewalls 8 of the course of blocks 2 below. The rear sidewalls 8 of block 2 rest on grade. Within blocks 2 are installed a plurality of paving blocks 76 in an array which the user finds aesthetically pleasing. The paving blocks 76 are nominally four inches by eight inches in size and approximately two to three inches in height. The paving blocks 76 are placed upon granular material filled in the cavities 14 and 16 of blocks 2 after the top segments 32 and 34 of webs 20 have been removed, typically by blows with a hammer to the vertical faces of top segments 32 and 34. The cavities 14 and 16 of blocks 2 are filled with sand or other granular materials to a level such that the tops of the paving blocks 54 are generally flush with the top edges 56 of blocks 2.

It can also be seen that grooves 52 of front sidewalls 4 of blocks 2 create a uniform appearance when viewed with seams 74 between adjacent blocks 2 in staircase 40.

Figure 5:
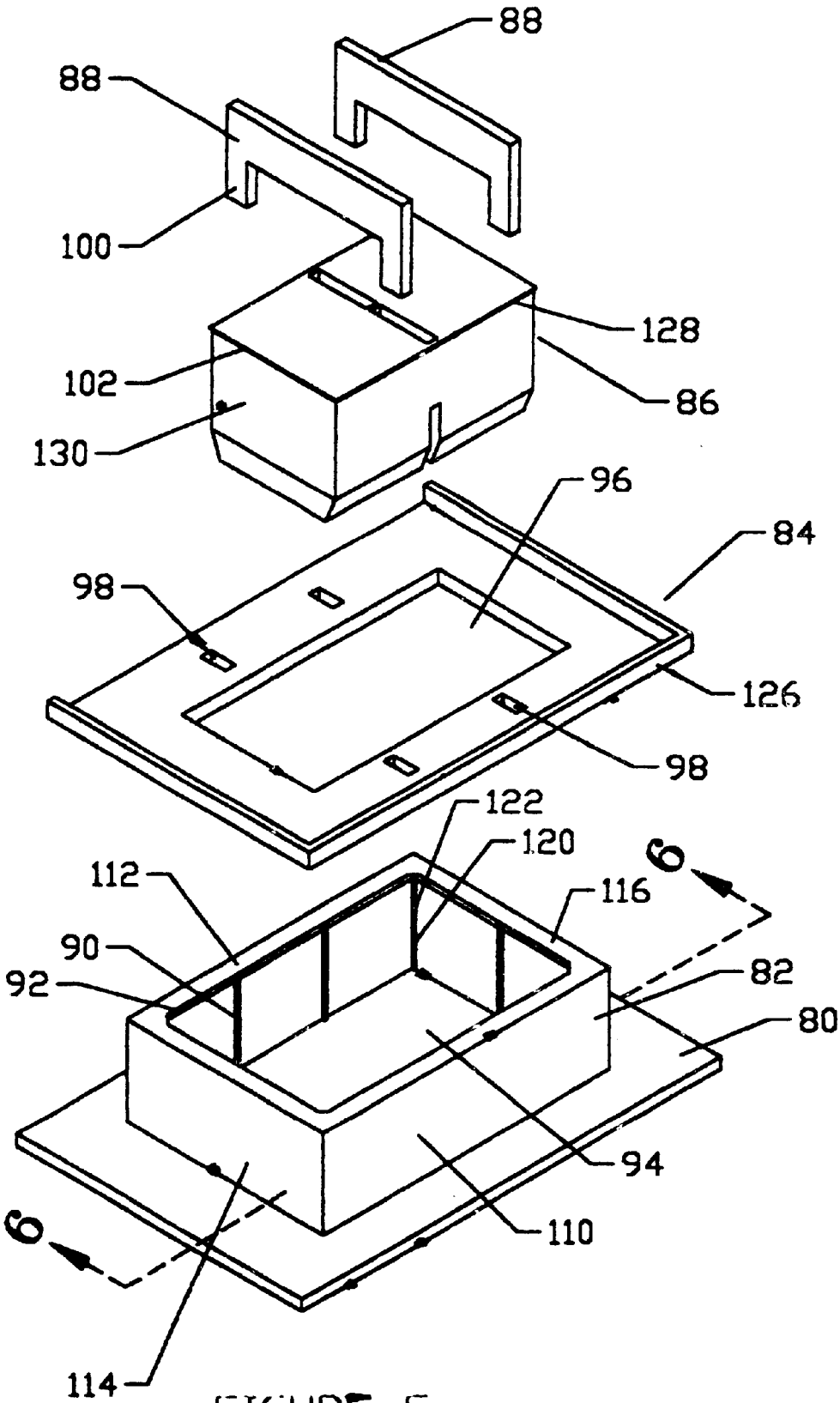
FIG. 5 is an exploded perspective view of an embodiment of the mold for making the block of FIGS. 1, 2, 3.
Figure 6:
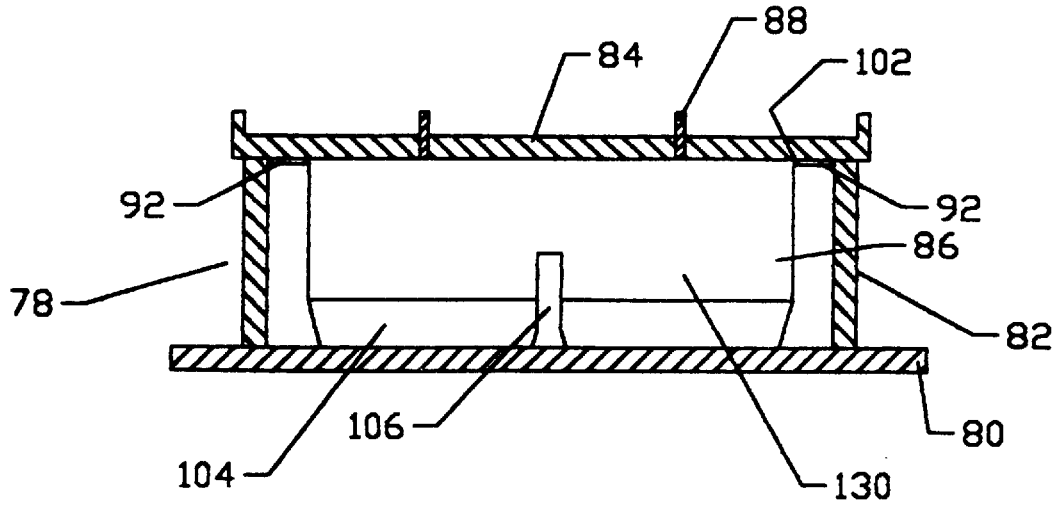
FIG. 6 is a cross section of the mold taken along lines 6—6 of FIG. 5.
Figure 7:
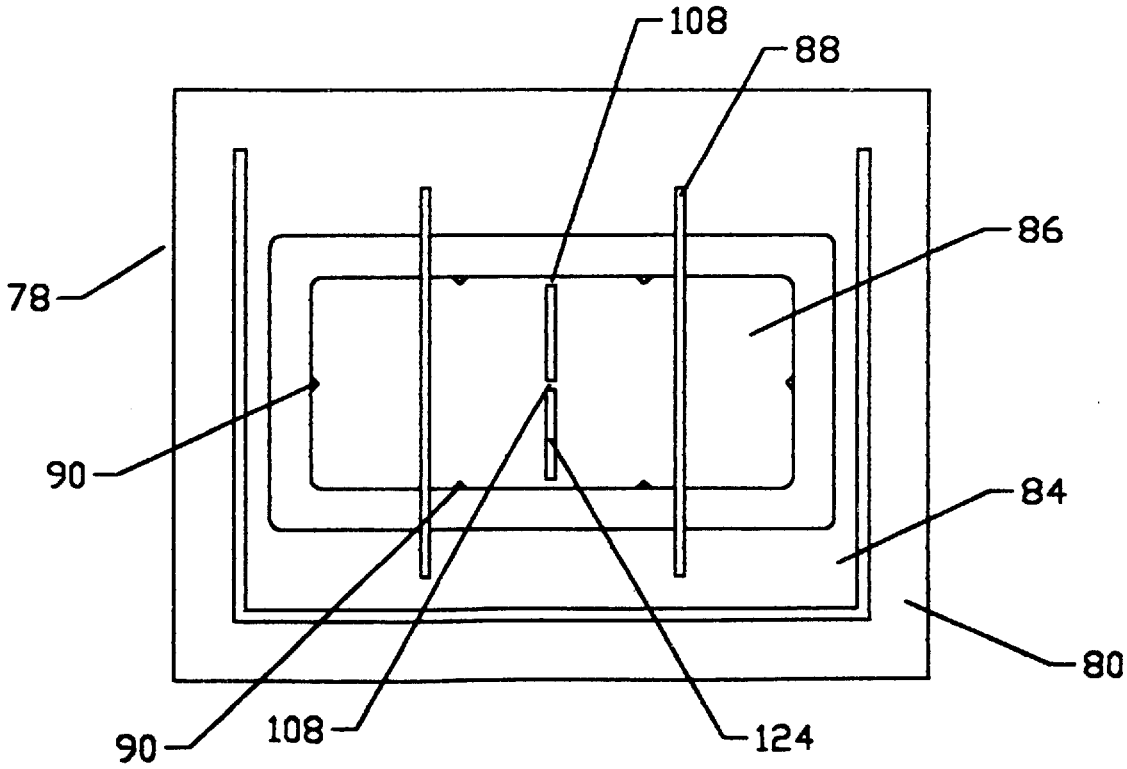
FIG. 7 is a top plan view of the mold of FIG. 5.

FIGS. 5, 6, and 7 illustrate a suitable mold 78 for forming the blocks 2 in a block-making machine.

Generally, the process for making this invention includes block molding the composite concrete block by filling a block mold 78 with zero slump concrete mix and casting the block by compressing the mix in the mold through the application of pressure to the exposed mix at the open upper end of the block mold 78. Dyes, colorants, pigments and other additives may be added to the mix depending upon the physical characteristics which are desired in the resulting block.

The fill is then loaded into a hopper which transports the fill to the mold 78 within the block machine. The mold 78 generally comprises at least four sides bordering a central cavity 94. A core member 86 may be placed in the mold cavity 94 prior to loading the mold 78 with block mix. Generally, the core member 86 may be supported by elongate hangers 88 positioned across opposing first 110 and second 112 sidewalls. The mold 78 may comprise any material which will withstand the pressure to be applied to the block fill by the head as is well known in the art.

The walls of the mold box 82 measure the height and width of the resulting blocks. Accordingly, the mold walls must be made of a thickness which will accommodate the processing parameters of block formation given a specific mold composition.

A flat pallet 80 which is vertically displaceable in a conventional block machine is initially seated against the bottom of mold box 82. Mold box 82 comprises a pair of oppositely disposed generally identical mold box side walls 110, 112 connected at their ends by end walls 114, 116. Each mold box wall 110, 112, 114, 116 is equal in height. The in-facing surfaces 118 of walls 110, 112, 114, 116 are each provided with vertically disposed elongate triangular ribs 90 which are spaced generally proportionally along walls 110, 112, 114, and 116. Each rib 90 extends from the top to the bottom of walls 110, 112, 114 and 116. At the interior corners 120 of mold 80 are gussets 122 which serve to create bevels 64 on the corners 60, 61, 62, 63 of a formed block 2. Ribs 90 form the grooves 52 in the surfaces 44, 46, 48 and 50 of block 2.

A surrounding downwardly concave lip 92 slightly overhangs cavity 94 within mold box 82 in order to form a rounded corner on the outside top edges of block 2.

Resting atop mold box 82 is mold top plate 84 which includes a central opening 96 of rectangular shape which coincides with the shape of cavity 94 of mold box 82. A surrounding low barrier 126 is fixed upon the top of mold top plate 84 at three sides of its periphery. Multiple slots 98 are provided through mold top plate 84 to receive tabs 100 of hangers 88.

Hangers 88 are fixedly mounted to core member 86 such that when core member 86 is lowered into cavity 94 of mold box 82, core member 86 is suspended from hangers 88 and disposed generally equidistant on its sides from mold box sidewalls 110, 112, and end walls 114, 116. Hangers 88 rest on mold top plate 84 when tabs 100 are received in slots 98 of mold top plate 84.

Core member 86 is sized such that it may seat on pallet 80 when in place in cavity 96. Core member 86 is provided around its periphery at its upper outer corners 128 with overhanging shelf 102 which forms inside rounded corners on the block 2.

Core member 86 is provided with ramp forms 104 at the lower end thereof which recede at an incline from the generally planar sides 130 of core member 86.

A recess 106 is disposed centrally in core member 86 to permit block mix to enter and form web 20 of block 2. Bridges 108 extend into recess 106 at the top of core member 86, each bridge 108 extending downwardly about four inches to form voids 22, 24, 26 of web 20 of block 2. Slits 124 in core member 86 are defined by pairs of bridges 108 and provide fill areas for block mix to enter to form the top segments 32, 34 of web 20.

In operation, the mold 78 is generally positioned in a block molding machine atop a removable or slidable pallet 80. The core member 86 is then placed into the mold box 82. The mold 78 is then loaded with block mix or fill.

Zero slump block mix may be introduced from a hopper above mold top plate 84 and enters cavity 94 and slits 124. The mold 78 is agitated vigorously for a brief period after which a scraper (not shown) is drawn across mold top plate 84 to remove excess fill. A conventional stripper head (not shown) is depressed upon the opening 96 of mold top plate 84 to compress the block mix within the mold 78. Preferably the head is patterned to avoid the support hangers 88 and core member 86. Thereafter, the stripper head further depresses as the pallet 80 is lowered from beneath the mold box 82 as the molded block 2 is stripped from the mold 78. The ramp forms 104 facilitate stripping of the block 2 from the mold 78 and strengthen the sidewalls 4, 8 and end walls 6, 10 of block 2 as pressure is exerted on the block mix while in the mold.

Once the blocks are formed, they may be cured through any means known to those of skill in the art. Curing mechanisms such as simple air curing, autoclaving, steam curing or mist curing, are all useful methods of curing the block of the present invention. A preferable means for curing blocks is by steam. The chamber temperature is slowly increased over two or three hours and then stabilized. The steam is gradually discontinued and the blocks are held at the eventual temperature, generally around 100–130 degrees F. for two to three hours. The heat is then turned off and the blocks are allowed to cool. In all instances, the blocks are generally allowed to sit for at least twenty-four hours before being stacked or stored.

Having described the invention, I claim:

1. A concrete block for a ground-borne staircase comprising:

a plurality of upright sides joined together at the ends thereof providing an open cavity therein, the plurality of upright sides forming outer corners of the block such that no end of an upright side extends past an outer corner, an upright web transversely disposed across said open cavity and interconnected to opposing ones of said sides, said web having a top edge and a bottom edge, said web of substantially smaller thickness than the thickness of said sides, said web has at least one elongate, narrow slot therein extending downward from the top edge of said web.

2. The block of claim 1 wherein said web is substantially shorter than said upright sides.

3. The block of claim 1 wherein said web has a slot at each interconnection thereof with said opposing sides, each slot extending downward from said top edge of said web.

4. The block of claim 1 wherein each of said upright sides has a lower portion and an upper portion, the lower portion of at least one of the upright sides thicker than the upper portions thereof.

5. The block of claim 1 wherein each of said upright sides comprises a lower portion and an upper portion, each of said upright sides has a bottom, each of the lower portions having a ramp region thereon, each of said ramp regions receding from the bottom of said upright side of which said ramp region is a part, said web of uniform thickness throughout.

6. The block of claim 1 wherein each of said upright sides has an outside surface, each outside surface having at least one vertical groove formed therein, each at least one vertical groove spaced evenly along the length of said outside surface.

7. The block of claim 6 wherein said block has vertical corners at the intersections of said upright sides, said vertical corners comprising bevels thereon.

8. The block of claim 1 wherein said upright sides of said block have top ends having outer horizontal edges, each horizontal edge of said top ends having a radius thereon.

9. A composite concrete block for use in a staircase in landscaping applications comprising:

first and second sidewalls, each of said sidewalls being substantially parallel to the other, opposed first and second end walls interconnecting said sidewalls at the ends thereof, said first and second sidewalls having a first thickness, said sidewalls and said end walls defining a generally planar upper surface and a generally planar lower surface, said upper surface and said lower surface being substantially parallel to each other and separated by a distance comprising the height of the block, said sidewalls and said end walls defining a cavity therewithin extending from said upper surface to said lower surface, a vertically disposed web traversing said cavity interconnecting said first and second sidewalls, said web having an upper edge and a lower edge, said web having a thickness substantially less than the first thickness of said first and second sidewalls, said web shorter than said sidewalls, said lower edge of said web coplanar with said lower surface defined by said sidewalls and said end walls.

10. The composite block of claim 9 wherein the web has at least one narrow, substantially vertical void extending from the upper edge of said web into said web.

11. The concrete block of claim 9 wherein the web is provided with a substantially vertical void therewithin at each interconnection of said web with said first and second sidewalls, said voids extending from the upper edge of said web into said web.

12. The concrete block of claim 11 wherein the web is provided with a narrow, substantially vertical slot generally equidistant from said interconnections of said web to said sidewalls.

13. The concrete block of claim 9 wherein the sidewalls and the endwalls each having an outer surface, at least one vertical groove is formed in the outer surface of at least one of the sidewalls and the end walls.

14. The composite concrete block of claim 9 wherein the web is provided with a substantially vertical narrow elongate void therewithin at each interconnection of said web with said first and second sidewalls, the web is provided with a substantially vertical narrow elongate void generally equidistant from said interconnections of said web to said sidewalls, each of said voids extending from the upper edge of said web into said web, the sidewalls and the endwalls each having an outer surface, at least one vertical groove is formed in the outer surface of at least one of the sidewalls and the end walls.

15. The composite concrete block of claim 9 wherein said web is uniform in thickness from the upper edge thereof to the lower edge thereof, each of said sidewalls having an inner face opposing the inner face of the opposing sidewall, each of said end walls having an inner face opposing the inner face of the opposing end wall, each sidewall and each end wall having a lower portion and an upper portion, the inner face of each sidewall having a ramp region thereon corresponding with the lower portion of said sidewall, the inner face of each end wall having a ramp region thereon corresponding with the lower portion of said end wall, each sidewall and each end wall increasing in thickness along said ramp region.

16. A method for constructing a ground borne staircase comprising preparing a surface of generally level material, placing an open block thereon, said block having upright sides defining a cavity and having a web traversing said cavity, said web having an upper portion, said upright sides each having a top, the tops of said upright sides defining an upper surface, breaking the upper portion of said web free from said block, loading said cavity of said block with fill material to a first level below said upper surface, the first level spaced vertically from said upper surface by generally the thickness of a paving block, placing paving blocks atop said fill material.

17. A staircase for a landscaping application comprising a first course of at least one stair block on a lowest level, at least a second course of at least a second stair block on a second level higher than the lowest level, each stair block comprising a concrete masonry block having first and second sidewalls, each of said sidewalls being substantially parallel to the other, opposed first and second end walls interconnecting said sidewalls at the ends thereof, said first and second sidewalls having a first thickness, said sidewalls and said end walls defining a generally planar upper surface and a generally planar lower surface, said upper surface and said lower surface being substantially parallel to each other and separated by a distance comprising the height of the block, said sidewalls and said end walls defining a cavity therewithin extending from said upper surface to said lower surface, a vertically disposed web traversing said cavity interconnecting said first and second sidewalls, said web having an upper edge and a lower edge, said web having a thickness substantially less than the thickness of said first and second sidewalls, said web of height less than the height of the sidewalls, the first sidewall of the at least a second block on the second level resting on the second sidewall of the at least one block on the lowest level, the upper surface of the at least one stair block of the first course substantially parallel to the upper surface of the at least a second stair block of the at least a second course, each cavity of the stair blocks being partially filled with fill material, each cavity of the stair blocks having a plurality of paving blocks placed therewithin upon the fill material therewithin, the paving blocks having upper surfaces generally horizontally aligned with the planar upper surfaces of the sidewalls of the stair block in which the paving blocks are disposed.

18. A concrete block comprising:

a plurality of upright sides joined together at the ends thereof to form outer corners of the block such that no upright side extends past one of the outer corners, the plurality of upright sides providing an open cavity therein, an upright web transversely disposed across said open cavity and interconnected to opposing ones of said sides, each upright side having a bottom end, the bottom end of each upright side coplanar with the bottom end of each other upright side, said web having a top edge and a bottom edge, said web of substantially smaller thickness than the thickness of said sides, said web has at least one elongate narrow vertical void therein extending downward from the top edge of said web.

19. The block of claim 18 wherein said web has an elongate, narrow void therein at each interconnection thereof with said opposing sides, each void extending downward from said top edge of said web.

20. The block of claim 18 wherein said web is substantially shorter than said upright sides, said bottom edge of said web is coplanar with the bottom end of each upright side.

* * * * *